United States Patent [19]

Cummings et al.

[11] 4,106,250

[45] Aug. 15, 1978

[54] SELF-INTERLOCKING STANDING SEAM FOR A BUILDING PANEL

[75] Inventors: Gary Eugene Cummings, Cape Coral; Gary Lee Harvey; Charles Wallace Dean, both of Fort Myers, all of Fla.

[73] Assignee: Dean Steel Buildings, Inc., Fort Myers, Fla.

[21] Appl. No.: 786,826

[22] Filed: Apr. 12, 1977

[51] Int. Cl.[2] ..... E04D 3/363

[52] U.S. Cl. ..... 52/394; 52/511; 52/522; 52/529; 52/531; 52/539; 52/552

[58] Field of Search ..... 52/588, 332, 529, 493, 52/528, 542, 520, 506, 522, 531, 394, 511, 539, 552; 138/167, 168

[56] References Cited

U.S. PATENT DOCUMENTS

| | | | |
|---|---|---|---|
| 598,270 | 2/1898 | McCallum | 52/529 |
| 1,715,008 | 5/1929 | Rose | 138/167 |
| 1,984,607 | 12/1934 | Twickler | 138/168 |
| 2,147,775 | 2/1939 | Miller et al. | 138/167 |
| 2,565,610 | 8/1951 | Kinghorn | 52/522 |
| 2,893,073 | 7/1959 | Humphrey | 52/588 X |
| 3,131,794 | 5/1964 | Bender | 52/588 |
| 3,304,680 | 2/1967 | Birdwell | 52/332 |
| 3,394,524 | 7/1968 | Howarth | 52/588 |
| 3,402,526 | 9/1968 | Baxter | 52/588 X |
| 3,462,906 | 8/1969 | Schroyer | 52/588 X |
| 3,469,873 | 9/1969 | Glaros | 52/588 X |
| 3,481,094 | 12/1969 | Taylor | 52/394 |
| 3,606,718 | 9/1971 | Curran | 52/588 X |
| 3,733,767 | 5/1973 | Craik | 52/529 |

FOREIGN PATENT DOCUMENTS

| | | | |
|---|---|---|---|
| 285,708 | 2/1966 | Australia | 52/536 |
| 872,817 | 7/1961 | United Kingdom | 52/529 |

*Primary Examiner*—Alfred C. Perham
*Attorney, Agent, or Firm*—Shoemaker and Mattare, Ltd.

[57] ABSTRACT

A self-interlocking standing seam for a building panel. The panel includes a male element on one lateral edge and a female element on the other lateral edge. The male element is wedged into a channel on the female element and is locked in place by a skirt on the female element. A fastener can be located on the panel lateral edge having either the male or female element thereon for securing the panel to a building element, such as a purlin.

8 Claims, 4 Drawing Figures

SELF-INTERLOCKING STANDING SEAM FOR A BUILDING PANEL

BACKGROUND OF THE INVENTION

The present invention relates to buidling materials, and more particularly, to building panels.

Interlocking building panels are often used for a variety of purposes, such as for side walls or for roof installations. These panels should be amenable to shipping and storage, as well as to easy and quick assembly.

Presently known panels often have one or more drawbacks. For example, many panels require special machines for on-site installation thereof, others require fasteners such as clips to connect adjoining panels together, while still others do not nest for easy shipping and/or storage. Often, the fasteners used to fasten the panels to a main building structure are exposed and thus vitiate the aesthetic appearance of the assembled structure. It is also noted that machines used for in situ installation often mar the panels which also detracts from the appearance thereof.

SUMMARY OF THE INVENTION

The panels embodying the teachings of the present invention are easily interlocked together and are easily stored and shipped.

Each panel comprises a male fastening element on one lateral edge and a female fastening element on the other lateral edge thereof. The female fastening element has a channel covered by a skirt portion and has a lip which is defined on one edge of the channel by a reverse bend. The male fastening element has an extension member which is wedged between the skirt and the lip of the female fastening element and into the channel to interlock adjoining panels together. The skirt is formed of a naturally resilient material so that the skirt yields to permit the male extension element to be wedged into the channel, but will lock that element into the channel once it is so placed. Fastener means connect the panels to the building main structure.

The panels can be used on either side wall or roof installations and are interlocked by simply interfitting the male and female elements of adjoining panels together and thus, no special machinery or other equipment is required to assemble a roof or side wall comprised of the building panels embodying the teachings of the present invention. The easy installation of the panels contributes to expeditious building erection, thus resulting in many cost savings.

The panels can have factory caulked side laps and require no clips or other such fasteners for the interlocking thereof. The fasteners attaching the panels to the building structure are hidden from view and thus do not detract from the overall appearance of the interlocked panels. Furthermore, there are no holes through exposed panels.

The panels are easily nested for storage and shipment, and the panels can be offered in a wide variety of sizes and colors. For example, widths of 60 inches and 24 inches can be offered, as well as a wide variety of prepainted colors.

OBJECTS OF THE INVENTION

It is, therefore, a main object of the present invention to provide panels which are interengageable by a self-interlocking standing seam.

It is another object of the present invention to provide a panel standing seam requiring no machinery to effect the interlocking of adjoining panels.

It is a further object of the present invention to provide means for interlocking adjoining panels which does not require any fasteners to effect the interlocking.

It is yet another object of the present invention to provide panels which can be mounted on a building structure using fasteners which are hidden from view.

It is yet a further object of the present invention to provide building panels having no holes through exposed panels.

It is still another object of the present invention to provide building panels which are easily nested together.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
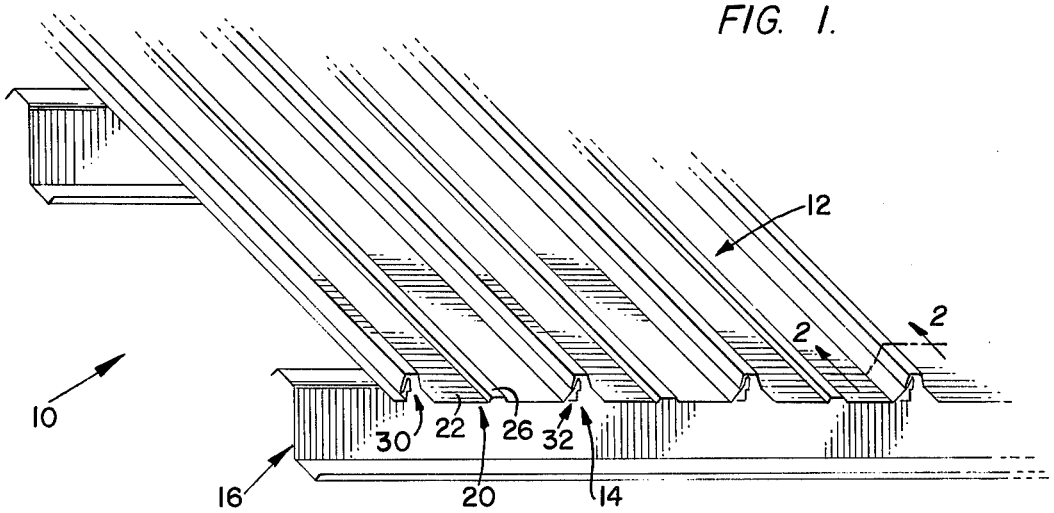
FIG. 1 is a perspective of a roof embodying the teachings of the present invention.

Shown in FIG. 1 is a roof 10 comprising a plurality of panels 12 coupled together using a seam 14 embodying the teachings of the present invention. The roof panels in FIG. 1 are mounted on purlins 16 to form the roof 10.

Each panel has a central section 20 comprising a plurality of planar sections 22 integrally connected together by a longitudinal rib 26 and each termination in one of a pair of lateral side edges 30 and 32.

Figure 2:
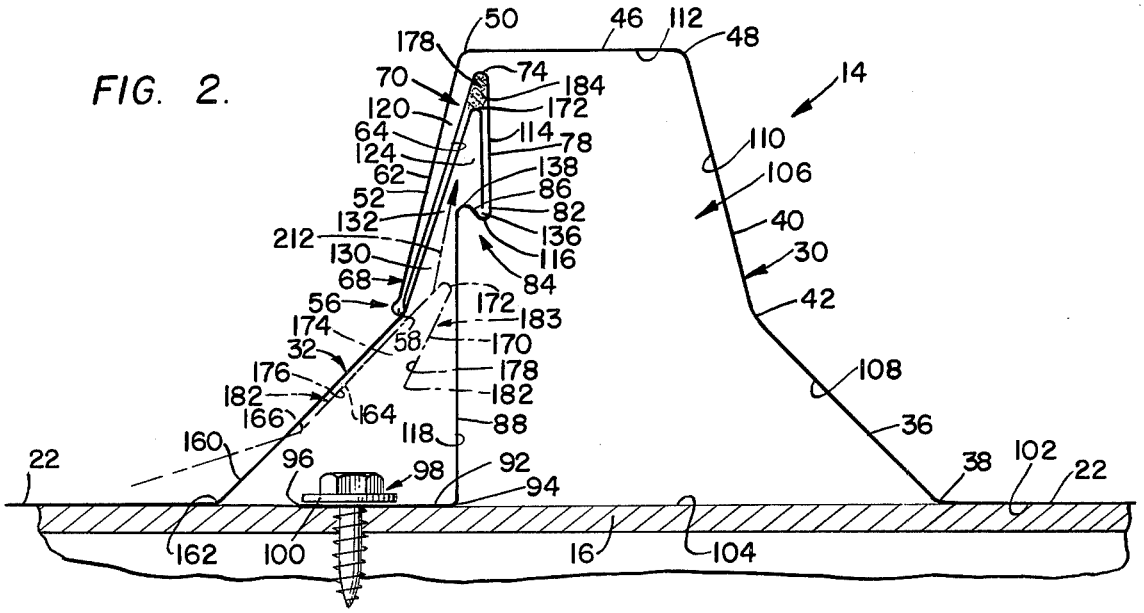
FIG. 2 is an elevation view taken along line 2—2 of FIG. 1.

The panels are interconnected at the lateral edges thereof to form either a roof 10 or a side wall, and the preferred form of the interconnection is best shown in FIG. 2.

The lateral edges of adjacent panels are locked together to form the engageable members of the roof or side wall. The adjacent panels form a pair of engageable members and the lateral edge 30 of one of those engageable members forms a female element and the lateral edge 32 of the other member forms a male element. The lateral edge 30 includes an elongate planar riser portion 36 integrally connected at one lateral edge thereof to planar section 22 to form a first angular corner 38 and at the other lateral edge thereof to an elongate, upwardly inclined planar portion 40 to form a second angular corner 42. An elongate planar top portion 46 is integrally connected to portion 40 along one lateral edge thereof at a third angular corner 48 and extends horizontally therefrom to be in spaced parallelism with the planar portions 22 and to be spaced apart therefrom by portions 36 and 40. The top portion has a fourth angular corner 50 along the other lateral edge thereof and has an elongate, outwardly declining skirt 52 integrally connected thereto at one lateral edge thereof via corner 50. The skirt angles outwardly of the lateral edge 30 and downwardly from the top, and the other lateral edge of the skirt is free and forms lower terminal end 56. The skirt extends longitudinally of the panel 20 and is co-extensive therewith.

In the preferred embodiment, the terminal end 56 has a knob 58 thereon.

The skirt has an outer face 62 and an inner face 64 integrally connected together at one end of each at the lower terminal end 56. As shown in FIG. 2, faces 62 and 64 are upwardly divergent from terminal end 56 to form a lower skirt section 68 and an upper skirt section 70 which is located adjacent the corner 50 and is thicker than the lower skirt section 68.

The inner face 64 terminates in a concave corner 74 which is rounded to be downwardly open and has face 64 tangentially and integrally joined thereto. An elongate planar interior face section 78 is vertically oriented and is tangentially and integrally joined to the corner 74 along one lateral edge of that face and extends downwardly therefrom.

Tangentially and integrally joined to the other, or lower, lateral edge of face 78 is a first curved portion 82 of a reverse bend connecting segment 84. The curved portion 82 is upwardly open and has a second curved portion 86 integrally connected thereto. The second curved portion is downwardly open and is smoothly connected to the first portion to form an ogee curve which has the longitudinal axis thereof horizontally oriented.

An elongate planar exterior face section 88 depends vertically from the segment 84 and is tangentially and integrally connected at one, or upper, lateral edge thereof to second portion 86 to be in spaced parallelism with interior face section 78 and to be offset therefrom by the connecting segment 84.

An elongate planar flange 92 is integrally connected to the other, or lower, lateral edge of the exterior face 88 to extend horizontally outward therefrom and to be co-planar with the panel sections 22. The flange 92 is connected to the exterior face 88 by a fifth angular corner 94 and extends outwardly therefrom a distance sufficient so that outer lateral edge 96 thereof is located outside of the terminal edge 56. The width of the flange as measured between corner 94 and edge 96 is selected so the flange can receive fastening means, such as self-tapping screw 98 having a sealing washer 100 thereon, which can be used to fasten the panel to the purlin by threading the fastener downwardly through the flange into the purlin with the lower surface 102 of the planar sections 22 flushly positioned on top surface 104 of the purlin.

A main interior chamber 106 is formed by the purlin top surface, and interior surfaces 108, 110, 112, 114, 116 and 118 of the riser portion, the inclined planar portion, the top portion, the interior face section, the connecting segment and the exterior face, respectively. The skirt 52 is hollow and thus forms a secondary chamber 120 connected to the primary chamber.

The skirt is spaced apart from both the faces 78 and 88 and defines with face 78 an open cavity 124 which is in the shape of an inverted V. A cavity mouth 130 is formed between face 88 and skirt 52 and has a throat section 132 formed between the segment 84 and the skirt 52 at the intersection of the face section 88 and the second curve 86. First curved portion 82 forms an internal pocket 136 having a ridge 138 thereon which is formed by the second curved portion 86, and the function of the pocket will be explained below.

Lateral edge 32 of each of the panels 20 interfits with lateral edge 30 of an adjoining panel and includes an elongate planar first slanting portion 160 integrally joined at a lower lateral edge thereof to planar section 22 by a sixth angular corner 162. An elongate planar second slanting portion 164 is integrally connected to the first slanting portion by a seventh angular corner 166 which connects an upper lateral edge of the first slanting portion to a lower lateral edge of the second slanting portion. The width of the first slanting portion as measured between corners 162 and 166 is selected so that terminal end 56 is located adjacent corner 166 when lower surfaces 102 of both adjoining panels are flushly mounted on upper surface 104 of the purlin.

A lip forming flange 170 is integrally connected to an upper lateral edge of the second slanting portion by a rounded corner 172 which is downwardly open so that an open chamber 174 in the shape of an inverted V is defined between inner surfaces 176 and 178 of the slanting portion 164 and flange 170, respectively.

The width of the second slanting portion 164 as measured between corners 166 and 172 is selected to be less than the width of face 64 of the skirt as measured between terminal end 56 and corner 74 so that corner 172 is spaced apart from the corner 74 when the free end 56 is immediately adjacent corner 166, thus defining a gap 178 between corners 74 and 172. The radii of curvature of the corners 74 and 172 are selected so that portion 164 is spaced apart from face 64 of the skirt and flange 170 is spaced apart from face 78 when edge 30 of one panel is interfit with edge 32 of an adjoining panel. The width of the flange 170 is measured between corner 172 and lower terminal end 182 of the flange is selected so the end 182 is positioned within pocket 136 when the two engageable members are thus interfit. The ridge 138 therefor serves as a stop to help to maintain the flange 170 in the proper position within the cavity 124.

A hook 183 is therefore defined by flange 170, corner 172 and second slanting section 164. The hook 183 forms an elongate extension on the male locking element which is received in the cavity defined on the female locking element.

Sealant, such as mastic 184, can be located in the gap 178 to seal the joint 14 in a suitable manner.

The panels are preferably formed of a metal-like material and the thickness of skirt sections 68 and 70 relative to each other, and the angle of declination of the skirt with respect to the vertical or face 88 is selected so that the skirt is properly spaced with respect to the lip portion and has a suitable resiliency. The skirt serves to hold the male element locked into the female element after interengagement of two adjacent panels, but must be sufficiently yieldable to permit the male element to be expeditiously inserted into the female element. The skirt also serves to cover the coupling once made to protect that coupling from dirt or other environmental factors which may detrimentally affect that coupling in some manner.

Figure 3:
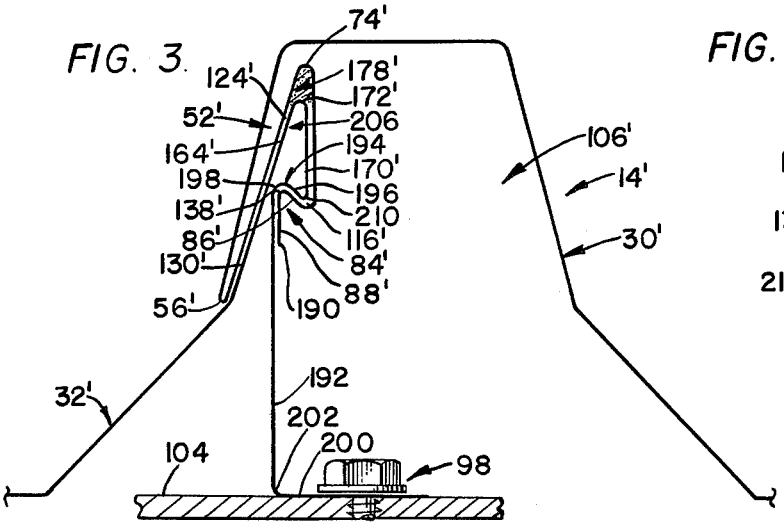
FIG. 3 is an elevation view showing an alternative embodiment of a building panels embodying the teachings of the present invention.

An alternative embodiment of the seam is shown in FIG. 3 and is denoted by the numeral 14'. Seam 14' has fastener 98 connecting edge 32' to the purlin, whereas seam 14 has the fastener connecting edge 30 to the purlin. The edge 30' has an exterior face 88' which has a lower terminal edge 190 located above surface 104 of the purlin. The connecting segment 84' is similar to the connecting segment 84 in the preferred embodiment.

Edge 32' has a lip forming flange 170' connected to an upright section 192 by a reverse bend corner 194 comprising a first curved portion 196 and a second curved portion 198 integrally connected together to form an ogee shape similar to that of connecting segment 84'. The ogee curve is horizontally disposed and the upright section 192 is in spaced parallelism with the lip forming flange 170' and offset therefrom by the corner 194. A fastener receiving flange 200 is integrally connected to the upright section 192 at the lower end thereof by an annular corner 202. The flange 200 extends horizontally outward of edge 32' to be located within chamber 106' of the edge 30'.

The radii of curvature of corners 74' and 172' and the size of the skirt 52' are selected so that tongue 206 formed by slanting section 164', flange 170', corner 174' and reverse bend 194 fits snugly within the cavity 124', with the slanting section, corner, flange and reverse bend spaced from the corresponding elements of the edge 30', as shown in FIG. 3. A gap 178' is thus defined to accommodate sealant, as in the preferred embodiment. The radii of curvature of the curved portions of the reverse bends 84' and 194 are selected so that the reverse bend and the upright section 192 are spaced apart from the reverse bend 84' and the face 88' when the panels are interconnected, as shown in FIG. 3.

The tongue 206 defines a male locking element received in a female locking element comprising the cavity 124'. The reverse bend 84' forms pocket 116', and the reverse bend 194 has a protruding lip 210 and the second curved portion 198 forms a neck shaped to receive lip 138' defined by second curved portion 86' of the reverse bend 84'. When the tongue 206 is locked into cavity 124' as shown in FIG. 3, the reverse bends 194 and 84' serve to form stops which help to prevent movement of the male element outwardly from the female element cavity.

As seen in FIGS. 2 and 3, the fasteners are hidden from view once the panels are assembled and thus do not detract from the outward appearance of the panels. A further result of these hidden fasteners is that there are no holes through exposed portions of the panels.

Figure 4:
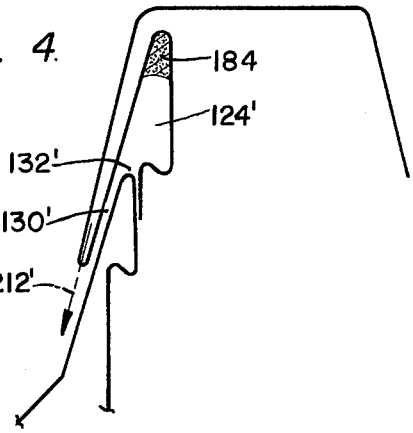
FIG. 4 is an end elevation illustrating assembly of the panels embodying the teachings of the present invention.

Assembly of panels is the same for either embodiment, but is illustrated in FIG. 4 for the alternative embodiment for the sake of convenience, as the phantom lines in FIG. 2 indicate the assembly process for the preferred embodiment.

To joint two engageable panels together, one panel is suitable secured to the purlin using a fastener, such as screw 98. The other panel is tilted with respect to the secured panel so that the male element is received in mouth 130 or 130' with the panels tilted with respect to each other as shown in FIG. 2. The unsecured panel is forced into interengagement with the secured panel either as indicated by arrow 212 in FIG. 2 or arrow 212' in FIG. 3, with the male element moving through throat 132 or 132' into the female element cavity 124 or 124'. The just interlocked panel is then secured, and the next panel is interlocked therewith in a similar manner. The process is repeated until the roof or side wall is desirably covered. The natural resiliency of the skirt enables that skirt to move to allow the male element to wedge through the throat and into the cavity 124 or 124' and into interlocking engagement with the edge 30 or 30' as shown in FIGS. 2 and 3.

The panels are thus self-interlocking and require no special on-site equipment to effect that interlocking. The panels need only be oriented with respect to a fastened panel, then interengaged. The locking is automatic and secure, thus expediting erection of the building.

In the preferred embodiment, the materials are 22 gauge, 24 gauge, and 26 gauge galvanized, pre-painted steel; or 0.032 aluminum or 0.040 aluminum.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A pair of elongate roof panel members comprising:

a male element on a longitudinal side edge of one member, said male element including a "V" shaped extension member which opens toward a roof on which said one member is mounted and has one leg thereof being connected to the one member, and the other leg thereof having an edge defining portion thereon;

a female element on the other panel member including a first channel defining portion on one longitudinal side edge thereof defining a channel which opens toward a roof on which said other panel member is mounted, said other member further including a double wall skirt member having one wall thereof connected to said first channel defining portion so that said skirt extends outwardly of said first channel defining portion and toward the roof on which said other panel member is mounted, said skirt having an end portion with the other wall thereof connected to said one wall at said end portion, said other member further including a first planar segment and a second channel defining portion connected to said skirt member other wall, said skirt defining one wall of said first channel, said second channel defining portion having a planar bottom segment connected to said skirt member other wall and having a lip portion offsettingly connecting said bottom segment to said first planar segment with said bottom segment being off-set from said first planar segment toward a center of said other member to define a second channel, said skirt extending over said second channel so that said skirt covers said second channel and said lip;

said male element "V" shaped extension member being wedged between said skirt and said lip with said edge defining portion being located between said lip and said bottom planar segment and captured between said lip and said bottom planar segment when said male element extension member other leg is located in said second channel to lock the engageable members together; and attaching means attaching one of said elements to a roof.

2. The engageable members of claim 1, wherein said female element is fastened to a building structural element.

3. The engageable members of claim 1, wherein said male element is fastened to a building structural element.

4. The engageable members of claim 1, wherein said female element further includes a curved corner along one side of said channel connecting said second channel to said skirt, a reverse bend connecting the other side of said channel to said first planar member, and said skirt diverging outwardly away from said lip defining a mouth through which said male extension member passes.

5. The engageable members of claim 3, wherein said male member further includes a vertical extension member, a slanting planar portion, a channel engaging portion, a curved corner along one side thereof connecting said slanting portion to one side of said channel engaging portion, a reverse bend connecting the other side of said channel engaging portion to said vertical extension member and forming said lip, and a flange on said vertical extension member, said flange receiving a fastening element, and said skirt diverging outwardly away from said lip defining a mouth through which said male extension member passes.

6. The engageable members of claim 5, wherein said channel engaging portion is sized to fit into said channel.

7. The engageable members of claim 1, further including a sealant positioned between said male element extension and said female element.

8. The engageable members of claim 4, wherein said reverse bend is in the shape of an ogee curve.

* * * * *